US012326043B1

(12) United States Patent
Clark

(10) Patent No.: US 12,326,043 B1
(45) Date of Patent: Jun. 10, 2025

(54) HYDROLOCK NOZZLE

(71) Applicant: Halliburton Energy Services, Inc., Houston, TX (US)

(72) Inventor: Kevin C. Clark, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/427,507

(22) Filed: Jan. 30, 2024

(51) Int. Cl.

| | |
|---|---|
| ***E21B 10/18*** | (2006.01) |
| ***E21B 10/60*** | (2006.01) |
| ***E21B 10/61*** | (2006.01) |
| ***E21B 33/12*** | (2006.01) |
| ***E21B 41/00*** | (2006.01) |

(52) U.S. Cl.
CPC ..... *E21B 10/18* (2013.01); *E21B 10/60* (2013.01); *E21B 10/61* (2013.01); *E21B 41/0078* (2013.01); *E21B 33/1208* (2013.01)

(58) Field of Classification Search
CPC ..... E21B 10/18; E21B 10/60; E21B 10/61; E21B 41/0078; E21B 33/1208
See application file for complete search history.

(56) References Cited

U.S. PATENT DOCUMENTS

| | | | | |
|---|---|---|---|---|
| 4,438,884 | A * | 3/1984 | O'Brien | F16B 21/04 285/376 |
| 4,542,798 | A | 9/1985 | Madigan | |
| 4,603,750 | A | 8/1986 | Sorenson | |
| 4,856,601 | A * | 8/1989 | Raney | E21B 10/43 175/417 |
| 4,878,548 | A | 11/1989 | Ostertag et al. | |
| 4,936,512 | A * | 6/1990 | Tremoulet, Jr. | B05B 1/02 285/379 |
| 6,244,340 | B1 * | 6/2001 | McGlothen | E21B 47/09 166/383 |
| 7,681,668 | B2 * | 3/2010 | Oxford | E21B 10/38 175/339 |
| 2013/0147633 | A1 * | 6/2013 | Sumrall | E21B 47/01 340/854.4 |

* cited by examiner

*Primary Examiner* — Steven A Macdonald
(74) *Attorney, Agent, or Firm* — Michael Jenney; C. Tumey Law Group PLLC

(57) ABSTRACT

A downhole system may include a downhole drill bit having at least one nozzle bore and a nozzle insert secured at least partially within the at least one nozzle bore. The nozzle insert may include a first radially outer sealing surface sealed against a first inner surface of the nozzle bore via a first seal feature, a second radially outer sealing surface sealed against a second inner surface of the nozzle bore via a second seal feature, and an annular threaded body portion to secure the nozzle insert within the at least one nozzle bore. The downhole system may further include a nozzle pressure chamber formed between the first seal feature, the second seal feature, a radially outer surface of the nozzle insert, and a radially inner surface of the at least one nozzle bore. The pressure chamber is configured to provide a retaining force on the nozzle insert.

20 Claims, 7 Drawing Sheets

HYDROLOCK NOZZLE

BACKGROUND

Various types of tools are used to form wellbores in subterranean formations for recovering hydrocarbons such as oil and gas lying beneath the surface. Examples of such tools include rotary drill bits (e.g., fixed-cutter drill bits, roller cone bits, hybrid drill bits, etc.), hole openers, reamers, and coring bits. In conventional wellbore operations, the tool is mounted on the end of a drill string and run-in-hole. With the tool positioned at a desired location, the tool is actuated to remove portions of the subterranean formations. For example, the tool may be a fixed-cutter drill bit configured to penetrate the subterranean formation with polycrystalline diamond compact (PDC) cutters secured to blades of the drill bit. At the surface of the wellbore, a rotary table or top drive may turn the drill string, thereby rotating the fixed-cutter drill bit to shear the subterranean formation.

Further, the tool (e.g., the fixed-cutter drill bit) may have a nozzle configured to output drilling fluid to help remove well cutting, minimize formation damage, lubricate the drill bit, etc. as the tool operates. The nozzle generally includes an insert threaded into a nozzle bore formed in the tool. Unfortunately, during operations, forces on the insert (e.g., pressure differentials, jet force, etc.) may drive the insert to eject from the nozzle bore, which may reduce the effectiveness of the nozzle and generally hinder wellbore operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for retaining a nozzle insert within a nozzle bore of a downhole tool (e.g., drill bit, hole opener, reamer, and coring bit) and, more particularly, example embodiments may include a nozzle insert and corresponding nozzle bore having features configured to form a nozzle pressure chamber for retaining (e.g., hydrolocking) the nozzle insert within the corresponding nozzle bore. As set forth in greater detail below, radially outer surfaces of the nozzle insert may be sealed against corresponding inner surfaces of the nozzle bore, via a plurality of seals, in response securing the nozzle insert with the corresponding nozzle bore, to form the nozzle pressure chamber. Based at least in part on the respective orientations of the surfaces and corresponding seals, the nozzle pressure chamber is configured to generate a retaining force (e.g., an axial force and/or a radial force) for retaining the nozzle insert within the corresponding nozzle bore.

Figure 1:
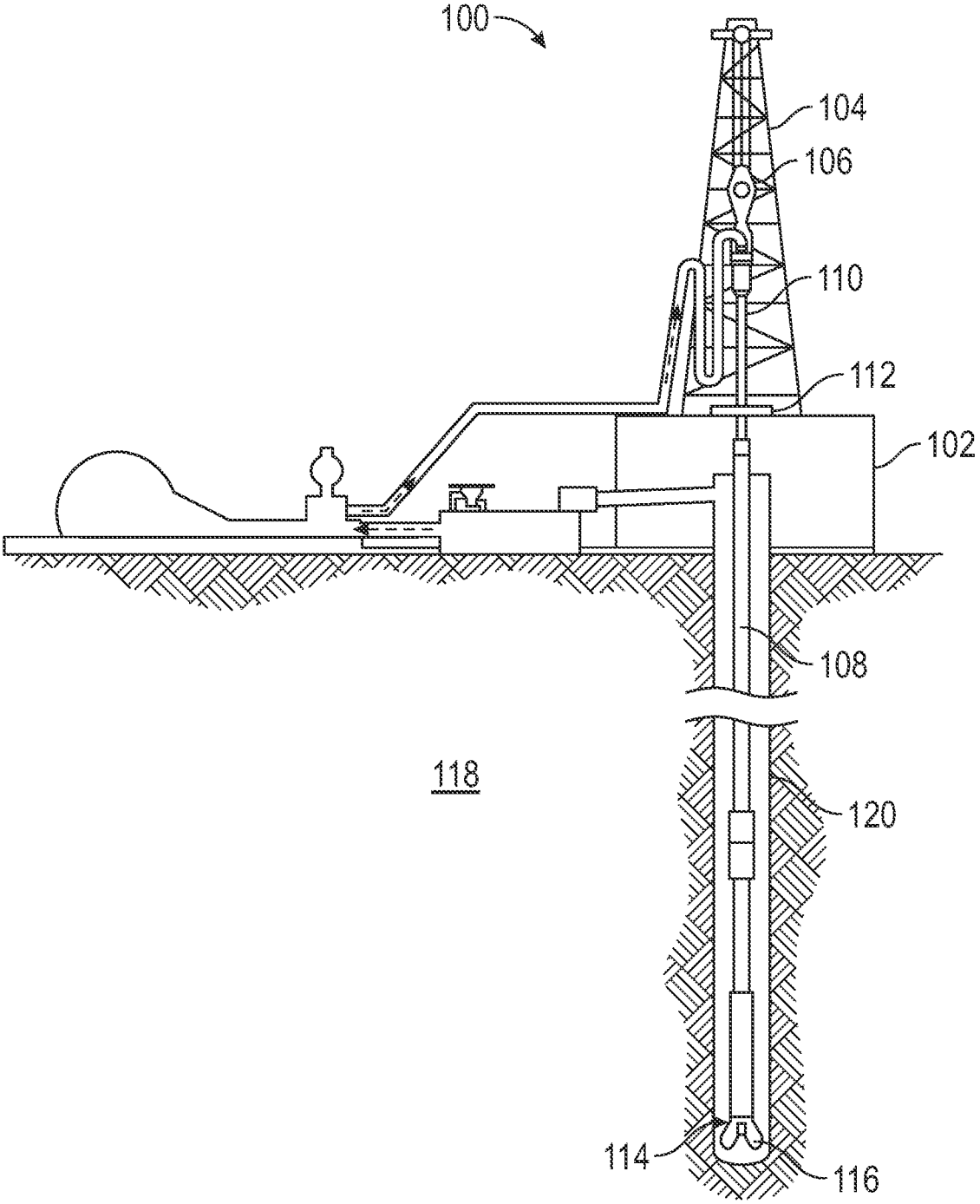
FIG. 1 illustrates an elevation view of a well system, in accordance with some embodiments of the present disclosure.

FIG. 1 illustrates an elevation view of a well system, in accordance with some embodiments of the present disclosure. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 includes a drilling platform 102 that supports a derrick 104 having a traveling block 106 for raising and lowering a drill string 108. The drill string 108 includes, but is not limited to, drill pipe, as generally known to those skilled in the art. A kelly 110 is lowered through a rotary table 112 and can be used to transmit rotary motion from the rotary table to the drill string 108. A downhole tool 114 (e.g., a drill bit, a hole opener, a reamer, a coring bit, etc.) is attached to the distal end of the drill string 108 and can be driven by a downhole motor and/or via rotation of the drill string 108. For example, the downhole tool 114 may be a drill bit 116 that rotates to penetrate various subterranean formations 118 to create a wellbore 120. Moreover, as set forth in detail below, the downhole tool 114 includes a nozzle (shown in FIG. 2) configured to output drilling fluid to at least help remove well cutting, minimize formation damage, and lubricate the downhole tool 114, as the downhole tool 114 operates.

Figure 2:
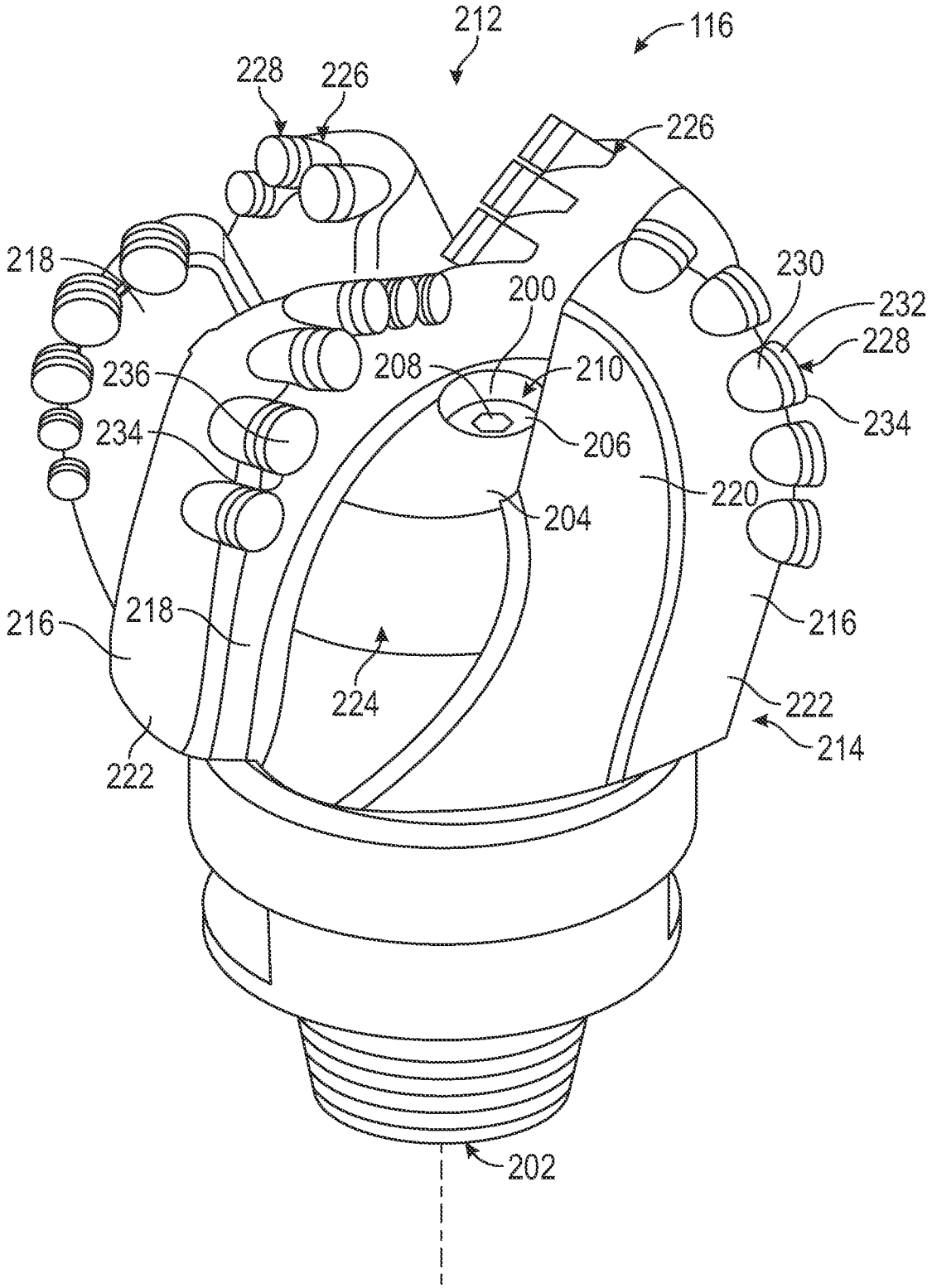
FIG. 2 illustrates a perspective view of a drill bit having at least one nozzle, in accordance with some embodiments of the present disclosure.

FIG. 2 illustrates a perspective view of a downhole drill bit having at least one downhole nozzle, in accordance with some embodiments of the present disclosure. The drill bit 116 may include at least one nozzle bore 200 extending through the drill bit 116. In particular, the at least one nozzle bore 200 may extend from a central bore 202 of the drill bit 116 to an outer surface 204 of the drill bit 116. A nozzle insert 206 may be secured at least partially within the at least one nozzle bore 200 via a threaded connection. However, the nozzle insert 206 may be secured within the at least one nozzle bore 200 via any suitable fastener. Further, as set forth in greater detail below, the nozzle insert 206 may be secured (e.g., threaded) into the at least one nozzle bore 200 of the drill bit 116 at surface to seal a nozzle pressure chamber (shown in FIG. 3) at atmospheric pressure.

Moreover, the nozzle insert 206 is configured to direct drilling fluid from the at least one nozzle bore 200 to the wellbore 120 (shown in FIG. 1). In particular, the at least one nozzle bore 200 may be fluidly connected to the central bore 202 of the drill bit 116, which is fluidly connected to the drill string 108 (shown in FIG. 1). During wellbore operations, as the fluid flows from the surface and down through the drill string 108 to the central bore 202 of the drill bit 116, a portion of the drilling fluid may flow into the at least one nozzle bore 200. As illustrated, the nozzle insert 206 disposed in the nozzle bore 200 may include an orifice 208 that extends through the nozzle insert 206. The orifice 208 may be configured to receive the drilling fluid flowing through the at least one nozzle bore 200 and output the drilling fluid into the wellbore 120. Generally, the drilling fluid output from a nozzle 210 of the drill bit 116 may help to at least remove well cutting, minimize formation damage, and lubricate the drill bit 116.

Moreover, the drill bit 116 may include any suitable drill bit for downhole drilling operations (e.g., a fixed cutter drill bit, a roller cone bit, a hybrid drill bit, etc.). For example, as illustrated, the drill bit 116 may be a fixed-cutter drill bit 212. A bit body 214 of the fixed-cutter drill bit 212 may have radially and longitudinally extending blades 216. The bit body 214, including the blades 216, may be made of a steel or metal-matrix composite of a harder material (e.g., tungsten carbide reinforcing particles dispersed in a binder alloy). The blades 216 have leading faces 218 oriented toward a direction of rotation of the drill bit, trailing faces 220 oriented opposite the direction of rotation of the drill bit 116, and exterior faces 222 oriented outward with respect to the bit body 214. The blades 216 are spaced apart from each other on the exterior of the bit body 214 to form fluid flow paths (e.g., junk slots 224) between leading faces 218 and trailing faces 220 of adjacent blades 216. As illustrated, the nozzle bore 200 of the at least one nozzle 210 may be positioned to output the drilling fluid at the junk slot 224. However, the nozzle bore 200 of the at least one nozzle 210 may be positioned in any suitable location on the drill bit 116.

Further, the blades 216 of the drill bit may include cutter pockets 226 formed in the exterior faces 222, the leading faces 218, and/or the trailing faces 220 of the blades 216. As illustrated, fixed cutters 228 may be secured within corresponding cutter pockets 226 formed in the leading faces 218 and/or exterior faces 222 of the blades 216. Each of the fixed cutters 228 will typically be secured within its respective cutter pocket 226 via brazing. Alternatively, the fixed cutters 228 may be secured at least partially within the respective fixed-cutter pocket 226 via threading, shrink-fitting, press-fitting, or any other suitable manufacturing or assembly method for fixedly securing the fixed cutters 228 to the bit body 214 such that the fixed cutter does not move with respect to the bit body 214 even while drilling. As set forth above, each of the fixed cutters 228 may be secured within the fixed-cutter pocket 226 at a predetermined angular orientation to position the fixed cutter 228 at a desired angle with respect to the subterranean formations 118 being penetrated. As the drill bit 116 is rotated, the fixed cutter 228 is driven through the subterranean formation 118 by the combined forces of the weight-on-bit and the torque experienced at the drill bit 116 to shear the various subterranean formations 118.

The fixed cutters 228 may each include a substrate 230 made of an extremely hard material (e.g., tungsten carbide) and a cutter element 232 secured to the substrate 230. The fixed cutters 228 may each include one or more layers of an ultra-hard material, such as polycrystalline diamond, polycrystalline cubic boron nitride, impregnated diamond, etc., which generally forms a cutting edge 234 and a working face 236 for each fixed cutter 228. The working face 236 is typically flat or planar. To form the fixed cutter 228, the substrate 230 may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate 230. As set forth above, the drilling fluid output via the at least one nozzle 210 may be configured to lubricate the drill bit 116 (e.g., lubricate the fixed cutters 228 and the blades 216) to reduce wear on the drill bit 116 during operation.

Figure 3:
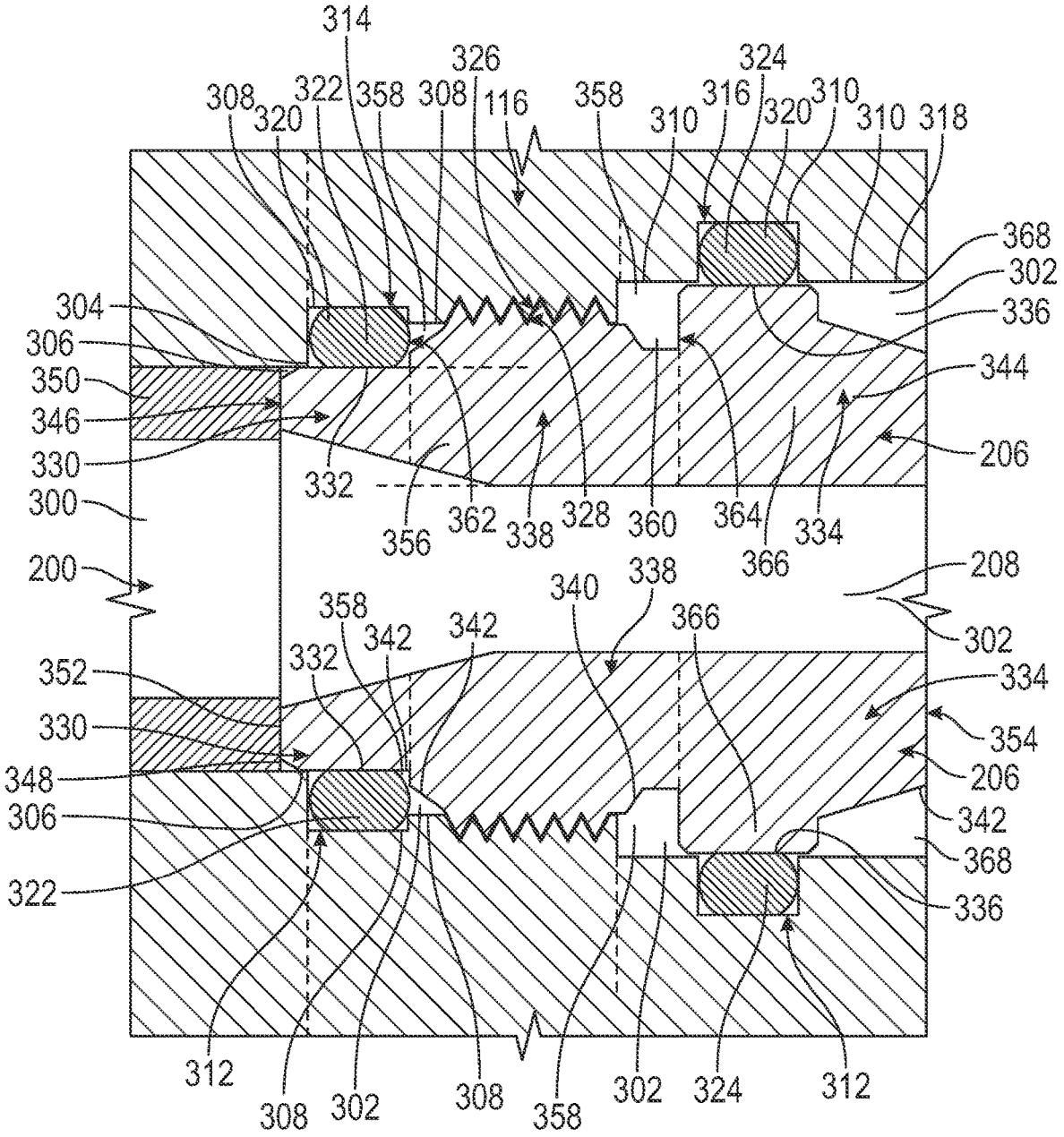
FIG. 3 illustrates a cross-sectional view of nozzle insert secured within a downhole drill bit, in accordance with some embodiments of the present disclosure.

FIG. 3 illustrates a cross-sectional view of nozzle insert secured within a downhole drill bit, in accordance with some embodiments of the present disclosure. As set forth above, the downhole drill bit 116 includes the at least one nozzle bore 200. The at least one nozzle bore 200 may have a main bore portion 300 and a nozzle portion 302. As illustrated, the main bore portion 300 may be radially offset from the nozzle portion 302 such that a nozzle bore shoulder 304 may formed at a transition between a main bore portion 300 and the nozzle portion 302. In particular, the nozzle bore shoulder 304 may be formed at a transition between a main inner surface 306 of the main bore portion 300 and a first inner surface 308 of the nozzle portion 302 of the at least one nozzle bore 200. Alternatively, the main inner surface 306 of the main bore portion 300 may be radially aligned with the first inner surface 308 of the nozzle portion 302.

As illustrated, the nozzle insert 206 may be secured at least partially within the at least one nozzle bore 200. In particular, the nozzle insert 206 may be secured at least partially within the nozzle portion 302 of the at least one nozzle bore 200. For reasons set forth in greater detail below, the nozzle portion 302 may have a variable diameter. For example, the nozzle portion 302 of the at least one nozzle bore 200 may include the first inner surface 308 and a second inner surface 310, which are radially offset from each other such that the diameter of the nozzle portion 302 decreases in the direction toward the main bore portion 300 of the nozzle bore 200. Further, as illustrated, the nozzle portion 302 may have a stepped diameter with the diameter of the second inner surface 310 being greater than the diameter of the first inner surface 308. However, the nozzle portion 302 may include any suitable profile.

Moreover, the at least one nozzle bore 200 may include a plurality of recesses 312 (e.g., a first recess 314 and a second recess 316) formed in an inner surface 318 of nozzle portion 302 and configured to hold corresponding seal features 320 (e.g., a first seal feature 322 and a second seal feature 324). In particular, the at least one nozzle bore 200 may include the first recess 314 formed in the first inner surface 308 of the nozzle portion 302 and the second recess 316 formed in the second inner surface 310 of the nozzle portion 302. As set forth in greater detail below, the first recess 314 may be configured to house the first seal feature 322 and the second recess 316 may be configured to house the second seal feature 324. Further, the least one nozzle bore 200 may include bore threading 326 formed on the inner surface 318 of nozzle portion 302, which is configured to interface with corresponding insert threading 328 of the nozzle insert 206. As illustrated, the bore threading 326 may be formed in the first inner surface 308 of the nozzle portion 302. However, the bore threading 326 may be formed in any suitable portion of the inner surface 318 of the nozzle portion 302.

As set forth above, the nozzle insert 206 may be secured at least partially within the nozzle portion 302 of the at least one nozzle bore 200. The nozzle insert 206 may include a first annular body portion 330 having a first radially outer sealing surface 332 configured to seal against the first inner surface 308 of the nozzle bore 200 via the first seal feature 322. That is, the first seal feature 322 may be disposed between the first radially outer sealing surface 332 and the first inner surface 308 of the nozzle bore 200 to seal the first radially outer sealing surface 332 against the first inner surface 308. As illustrated, the first seal feature 322 includes an annular seal (e.g., a first O-ring) disposed about and in contact with the first radially outer sealing surface 332. Further, the first seal feature 322 is disposed at least partially within the first recess 314 and in contact with the portion of the first inner surface 308 forming the first recess 314. As such, the first seal feature 322 may seal the first radially outer sealing surface 332 against the first inner surface 308. Moreover, as set forth above, the first seal feature 322 may include the first O-ring. However, the first seal feature 322 may include any suitable type of seal feature 320 (e.g., an O-ring, a Polypak seal, a lip seal, a V-seal, etc.).

Further, the nozzle insert 206 may include a second annular body portion 334 having a second radially outer sealing surface 336 configured to seal against the second inner surface 310 of the nozzle bore 200 via the second seal feature 324. That is, the second seal feature 324 may be disposed between the second radially outer sealing surface 336 and the second inner surface 310 of the nozzle bore 200 to seal the second radially outer sealing surface 336 against the second inner surface 310. As illustrated, the second seal feature 324 includes an annular seal (e.g., a second O-ring) disposed about and in contact with the second radially outer sealing surface 336. Further, the second seal feature 324 is disposed at least partially within the second recess 316 and in contact with the portion of the second inner surface 310 forming the second recess 316. As such, the second seal feature 324 may seal the second radially outer sealing surface 336 against the second inner surface 310. Moreover, as set forth above, the second seal feature 324 may include the second O-ring. However, the second seal feature 324 may include any suitable type of seal feature 320 (e.g., an O-ring, a Polypak seal, a lip seal, a V-seal, etc.)

Moreover, the second radially outer sealing surface 336 of the second annular body portion 334 may be disposed radially outward from the first radially outer sealing surface 332 of the first annular body portion 330. That is, the outer diameter of the second annular body portion 334 may be greater than the outer diameter of the first annular body portion 330 such that the second radially outer sealing surface 336 may be disposed radially outward from the first radially outer sealing surface 332. Accordingly, the inner diameter of the first seal feature 322 (e.g., the first O-ring) may be smaller than the inner diameter of the second seal feature 324 (e.g., the second O-ring). As set forth above, the nozzle portion 302 may have a stepped diameter with the diameter of the second inner surface 310 being greater than the diameter of the first inner surface 308. The respective diameters of the first annular body portion 330, the first seal feature 322, and first recess 314 of the first inner surface 308, may include any suitable diameters such that the first annular body portion 330 may be sealed against the first inner surface 308 via the first seal feature 322. Further, the respective diameters of the second annular body portion 334, the second seal feature 324, and second recess 316 of the second inner surface 310, may include any suitable diameters such that the second annular body portion 334 may be sealed against the second inner surface 310 via the second seal feature 324.

The nozzle insert 206 may further include an annular threaded body portion 338 having insert threading 328 configured to interface with the corresponding bore threading 326 of the at least one nozzle bore 200 to secure the nozzle insert 206 within the at least one nozzle bore 200. The insert threading 328 may be formed in a radially outer surface 340 of the annular threaded body portion 338. As illustrated, the annular threaded body portion 338 may be disposed axially between the first annular body portion 330 and the second annular body portion 334. However, the annular threaded body portion 338 may be disposed in any suitable position along a radially outer surface 342 of the nozzle insert 206. Further, as illustrated, the insert threading 328 may be disposed radially between the second radially outer sealing surface 336 of the second annular body portion 334 and the first radially outer sealing surface 332 of the first annular body portion 330. Alternatively, the insert threading 328 may be radially aligned with the second radially outer sealing surface 336, radially aligned with the first radially outer sealing surface 332 or disposed in any other suitable radial position with respect to the first radially outer sealing surface 332 and the second radially outer sealing surface 336.

Moreover, the first annular body portion 330, the second annular body portion 334, and the annular threaded body portion 338 may form a body 344 of the nozzle insert 206. As illustrated, the first annular body portion 330 may form a proximal end 346 of the body 344, which may be disposed proximate the main bore portion 300 of the nozzle bore 200 with the nozzle insert 206 secured within the nozzle bore 200. The first annular body portion 330 may include an inner axial face 348 formed at the proximal end 346 of the body 344. The inner axial face 348 may be configured to interface with the nozzle bore shoulder 304 to restrain axially inward movement of the nozzle insert 206 with respect to the nozzle bore 200. That is, the inner axial face 348 may land on the nozzle bore shoulder 304 at a fully inserted position to restrain further axial movement of the nozzle insert 206 with respect to the nozzle bore 200. Alternatively, as illustrated, the downhole drill bit 116 may include a nozzle sleeve 350 secured within the main bore portion 300 of the nozzle bore 200. The inner axial face 348 may instead land on a distal end face 352 of the nozzle sleeve 350 to restrain further axial movement of the nozzle insert 206 with respect to the nozzle bore 200 at the fully inserted position.

Further, the second annular body portion 334 may form a distal end 354 of the body 344, which may be disposed proximate an outer surface of the drill bit with the nozzle insert secured within the nozzle bore 200. As such, the second radially outer sealing surface 336 may be disposed axially between the wellbore 120 and the first radially outer sealing surface 332. Also, as set forth above, the annular threaded body portion 338 may form a portion of the body 344 of the nozzle insert 206 disposed between the first annular body portion 330 and the second annular body portion 334. However, the annular threaded body portion 338 may form any suitable portion of the body 344 of the nozzle insert 206.

As illustrated, the nozzle insert 206 may also include the orifice 208 extending axially through the body 344 of the nozzle insert 206. That is, the orifice 208 may extend axially through the first annular body portion 334, the second annular body portion 334, and the annular threaded body portion 338. As set forth above, the orifice 208 is configured to receive fluid flow from the nozzle bore 200 and direct the fluid flow toward the wellbore 120 to assist with drilling operations. During drilling operations, the fluid flowing through the orifice 208 may generate a jet force to bias the nozzle insert 206 out of the nozzle bore 200 and toward the wellbore 120. Additionally, a pressure inside of the drill bit 116 (e.g., within the nozzle bore 200) may be higher than a wellbore pressure such that a differential pressure force may bias an inner radial portion 356 of the body 344 of the nozzle insert 206 out of the nozzle bore 200 and toward the wellbore 120. Generally, a combination of the jet force and the differential pressure force may result in the unthreading and ejection of a traditional nozzle insert during drilling operations, which may hinder drilling performance. However, the present system is configured to generate a retaining force (e.g., hydrostatic pressure force) to help retain the nozzle insert 206 within the nozzle bore 200 during drilling operations. Specifically, an interface between the nozzle insert 206 and the nozzle bore 200 may form a nozzle pressure chamber 358 configured to generate the retaining force.

As illustrated, the nozzle pressure chamber 358 may be formed in an annular gap 360 positioned between the first seal feature 322, the second seal feature 324, the radially outer surface 342 of the nozzle insert 206 and the inner surface 318 of the at least one nozzle bore 200. The radially outer surface 342 of the nozzle insert 206 (e.g., the first radially outer sealing surface 332) is sealed against the inner surface 318 of the at least one nozzle bore 200 (e.g., the first inner surface 308), via the first seal feature 322, at an inner end 362 of the nozzle pressure chamber 358. Further, the radially outer surface 342 of the nozzle insert 206 (e.g., the second radially outer sealing surface 336) is sealed against the inner surface 318 of the at least one nozzle bore 200 (e.g., the second inner surface 310), via the second seal feature 324, at an outer end 364 of the nozzle pressure chamber 358. As such, the nozzle pressure chamber 358 may be sealed with the nozzle insert 206 secured within the nozzle bore 200. Further, as set forth above, the nozzle insert 206 may be secured within the nozzle bore 200 at the surface of a drilling operation such that the nozzle pressure chamber 358 is sealed with fluid (e.g., air) at atmospheric pressure within the nozzle pressure chamber 358.

Further, as set forth above, the second radially outer sealing surface 336 of the second annular body portion 334 may be disposed radially outward from the first radially outer sealing surface 332 of the first annular body portion 330 such that the second seal feature 324 seals against the second radially outer sealing surface 336 at a position radially outward from where the first seal feature 322 seals against the first radially outer sealing surface 332. As illustrated, the nozzle pressure chamber 358 may extend radially outward from the first radially outer sealing surface 332 to the second radially outer sealing surface 336. Moreover, the first annular body portion 330 may be disposed radially inward from the nozzle pressure chamber 358. However, at least a portion of the second annular body portion 334 may be radially aligned with the nozzle pressure chamber 358. Indeed, at least a radial protrusion portion 366 of the second annular body portion 334 may be disposed axially between the nozzle pressure chamber 358 and an open portion 368 of the nozzle bore 200 that is in fluid communication with the wellbore 120 (e.g., annulus). As set forth above, the nozzle pressure chamber 358 may contain fluid at atmospheric pressure, which may be lower than the wellbore pressure in the open portion 368 of the nozzle bore 200. The pressure differential between the nozzle pressure chamber 358 and the open portion 368 may generate the retaining force (e.g., an axial force and/or radial force) to bias the nozzle insert 206 into the nozzle bore 200 and help retain the nozzle insert 206 within the nozzle bore 200 during drilling operations.

Figure 4:
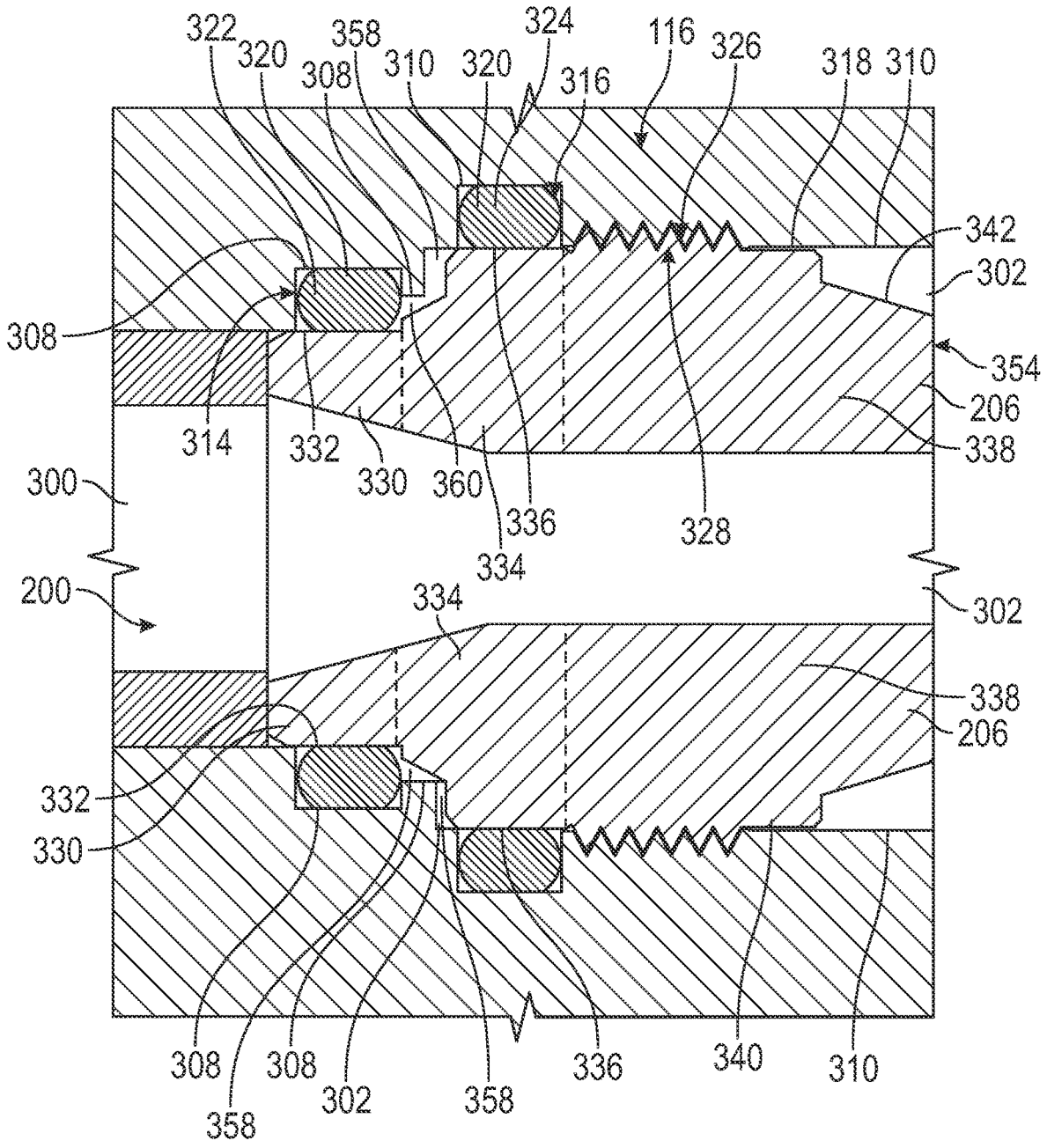
FIG. 4 illustrates a cross-sectional view of nozzle insert having adjacent sealing features, in accordance with some embodiments of the present disclosure.

FIG. 4 illustrates a cross-sectional view of nozzle insert having adjacent sealing features, in accordance with some embodiments of the present disclosure. As set forth above, the downhole drill bit 116 includes the at least one nozzle bore 200 with the main bore portion 300 and the nozzle portion 302. The nozzle portion 302 may have a stepped diameter with the diameter of the second inner surface 310 being greater than the diameter of the first inner surface 308. As illustrated, the first recess 314 is formed in the first inner surface 308 of the nozzle portion 302 and the second recess 316 is formed in the second inner surface 310 of the nozzle portion 302 to house respective seal features 320 (e.g., the first seal feature 322 and the second seal feature 324). Further, the least one nozzle bore 200 may include the bore threading 326 formed on the inner surface 318 of nozzle portion 302, which is configured to interface with the corresponding insert threading 328 of the nozzle insert 206. As illustrated, the bore threading 326 may be formed in the second inner surface 310 of the nozzle portion 302 between the second recess 316 and the outer surface 204 of the drill bit 116. However, the bore threading 326 may be formed in any suitable portion of the inner surface 318 of the nozzle portion 302.

Moreover, the nozzle insert 206 may be secured at least partially within the nozzle portion 302 of the at least one nozzle bore 200. As set forth above, the nozzle insert 206 may include the first annular body portion 330 having the first radially outer sealing surface 332 configured to seal against the first inner surface 308 of the nozzle bore 200 via the first seal feature 322. The nozzle insert 206 may also include the second annular body portion 334 having the second radially outer sealing surface 336 configured to seal against the second inner surface 310 of the nozzle bore 200 via the second seal feature 324. Further, the nozzle insert 206 may include the annular threaded body portion 338 having the insert threading 328 configured to interface with the corresponding bore threading 326 of the at least one nozzle bore 200 to secure the nozzle insert 206 within the at least one nozzle bore 200.

The insert threading 328 may be formed in the radially outer surface 340 of the annular threaded body portion 338. The insert threading 328 may be radially aligned with the second radially outer sealing surface 336. However, the insert threading 328 may be disposed in any suitable radial position with respect to the first radially outer sealing surface 332 and the second radially outer sealing surface 336. Moreover, as illustrated, the annular threaded body portion 338 may be disposed axially between the second annular body portion 334 and the wellbore 120. That is, the annular threaded body portion 338 may be disposed axially between the second annular body portion 334 and the distal end 354 of the nozzle insert 206. Further, the second radially outer sealing surface 336 may be disposed axially between the annular threaded body portion 338 and the first radially outer sealing surface 332. Indeed, as illustrated, the first radially outer sealing surface 332 and corresponding first seal feature 322 may be disposed adjacent to the second radially outer sealing surface 336 and corresponding second seal feature 324. However, the first seal feature 322 may be axially offset from the second seal feature 324 to form the nozzle pressure chamber 358. Alternatively, the annular threaded body portion 338 may be disposed between the main bore portion 300 of the nozzle bore 200 and the first annular body portion 330, and the first annular body portion 330 may be disposed between the annular threaded body portion 338 and the second annular body portion 334.

As set forth above, the nozzle pressure chamber 358 may be formed in the annular gap 360 positioned between the first seal feature 322, the second seal feature 324, the radially outer surface 342 of the nozzle insert 206 and the radially inner surface 318 of the at least one nozzle bore 200. Further, as set forth above, the second radially outer sealing surface 336 of the second annular body portion 334 may be disposed radially outward from the first radially outer sealing surface 332 of the first annular body portion 330 such that the second seal feature 324 seals against the second radially outer sealing surface 336 at a position radially outward from where the first seal feature 322 seals against the first radially outer sealing surface 332. As illustrated, the nozzle pressure chamber 358 may extend radially outward from the first radially outer sealing surface 332 to the second radially outer sealing surface 336. Moreover, as set forth above, the pressure differential between the nozzle pressure chamber 358 and the wellbore 120 may generate the retaining force to bias the nozzle insert 206 into the nozzle bore 200 and help retain the nozzle insert 206 within the nozzle bore 200 during drilling operations.

Figure 5:
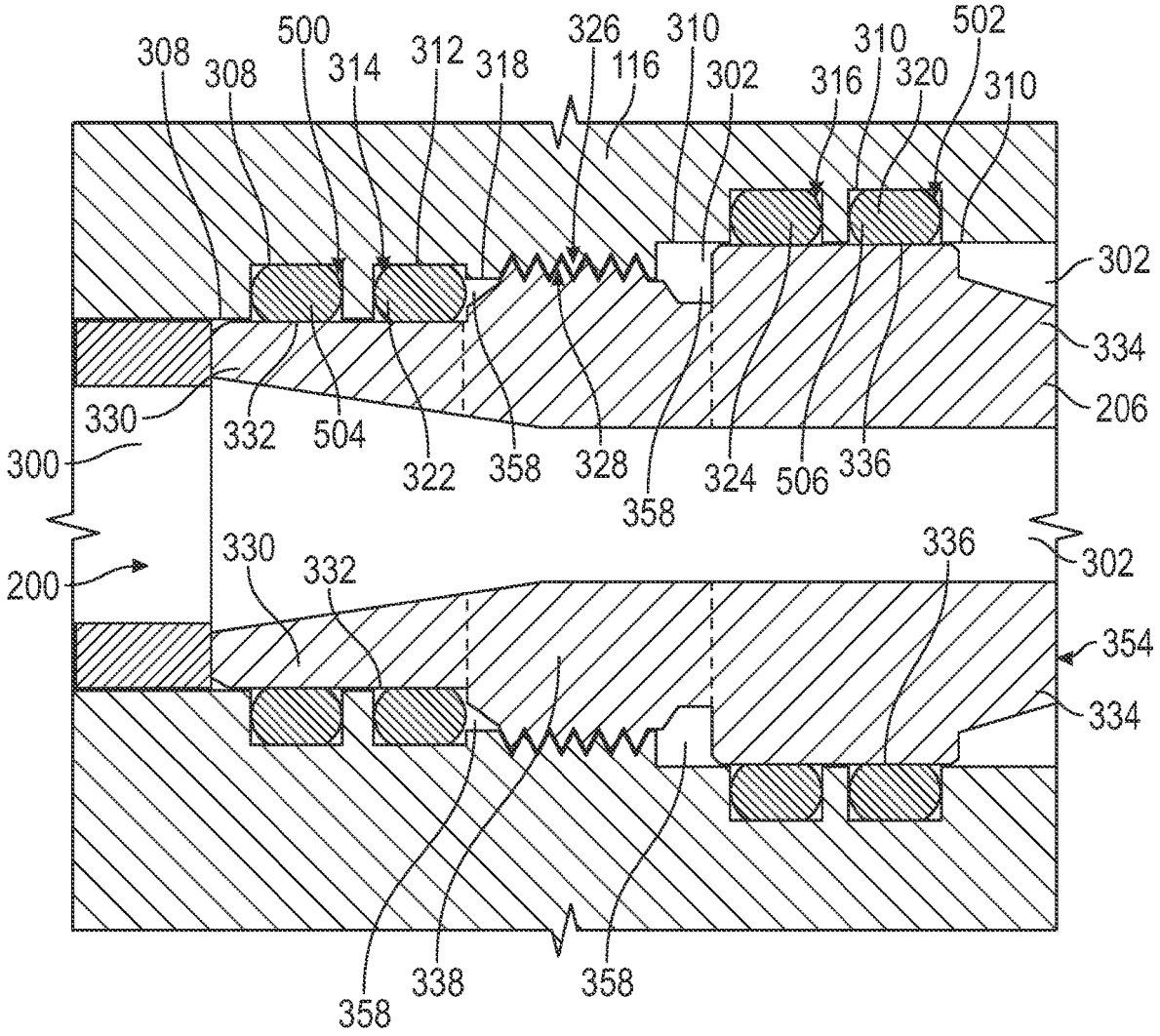
FIG. 5 illustrates a cross-sectional view of nozzle insert having a plurality of sealing features contacting each sealing surface of the nozzle insert, in accordance with some embodiments of the present disclosure.

FIG. 5 illustrates a cross-sectional view of nozzle insert having a plurality of sealing features contacting each sealing surface of the nozzle insert, in accordance with some embodiments of the present disclosure. As set forth above, the downhole drill bit 116 includes the at least one nozzle bore 200 with the main bore portion 300 and the nozzle portion 302. The nozzle portion 302 may have a stepped diameter with the diameter of the second inner surface 310 being greater than the diameter of the first inner surface 308.

Further, the nozzle portion 302 may include the plurality of recesses 312 formed in the inner surface 318 of the nozzle portion 302. As illustrated, the first recess 314 and a third recess 500 may be formed in the first inner surface 308 of the nozzle portion 302, and the second recess 316 and a fourth recess 502 may be formed in the second inner surface 310 of the nozzle portion 302 to house respective seal features 320 (e.g., the first seal feature 322, a third seal feature 504, the second seal feature 324, and a fourth seal feature 506). Further, the least one nozzle bore 200 may include the bore threading 326 formed on the inner surface 318 of nozzle portion 302, which is configured to interface with the corresponding insert threading 328 of the nozzle insert 206. As illustrated, the bore threading 326 may be formed in the first inner surface 308 of the nozzle portion 302. However, the bore threading 326 may be formed in any suitable portion of the inner surface 318 of the nozzle portion 302.

Moreover, the nozzle insert 206 may be secured at least partially within the nozzle portion 302 of the at least one nozzle bore 200. As set forth above, the nozzle insert 206 may include the first annular body portion 330 having the first radially outer sealing surface 332 configured to seal against the first inner surface 308 of the nozzle bore 200 via the first seal feature 322 and the third seal feature 504. In particular, the first seal feature 322 may be disposed between the first radially outer sealing surface 332 and the first recess 314 of the first inner surface 308 of the nozzle bore 200 to seal the first radially outer sealing surface 332 against the first inner surface 308. Further, the third seal feature 504 may be disposed between the first radially outer sealing surface 332 and the third recess 500 of the first inner surface 308 of the nozzle bore 200 to help seal the first radially outer sealing surface 332 against the first inner surface 308. Indeed, the third seal feature 504 may be disposed adjacent to the first seal feature 322. Further, as illustrated, the first seal feature 322 and the third seal feature 504 may both be disposed axially between the main bore portion 300 of the nozzle bore 200 and the annular threaded body portion 338 of the nozzle insert 206.

The nozzle insert 206 may also include the second annular body portion 334 having the second radially outer sealing surface 336 configured to seal against the second inner surface 310 of the nozzle bore 200 via the second seal feature 324 and the fourth seal feature 506. In particular, the second seal feature 324 may be disposed between the second radially outer sealing surface 336 and the second recess 316 of the second inner surface 310 of the nozzle bore 200 to seal the second radially outer sealing surface 336 against the second inner surface 310. Further, the fourth seal feature 506 may be disposed between the second radially outer sealing surface 336 and the fourth recess 502 of the second inner surface 310 of the nozzle bore 200 to seal the second radially outer sealing surface 336 against the second inner surface 310. Indeed, the fourth seal feature 506 may be disposed adjacent to the second seal feature 324. Further, as illustrated, the second seal feature 324 and the fourth seal feature 506 may both be disposed axially between the annular threaded body portion 338 of the nozzle insert 206 and the distal end 354 of the nozzle insert 206. Moreover, having the additional seal features (e.g., the third seal feature 504 and the fourth seal feature 506) may help isolate the fluid disposed in the nozzle pressure chamber 358 from the wellbore 120.

Figure 6:
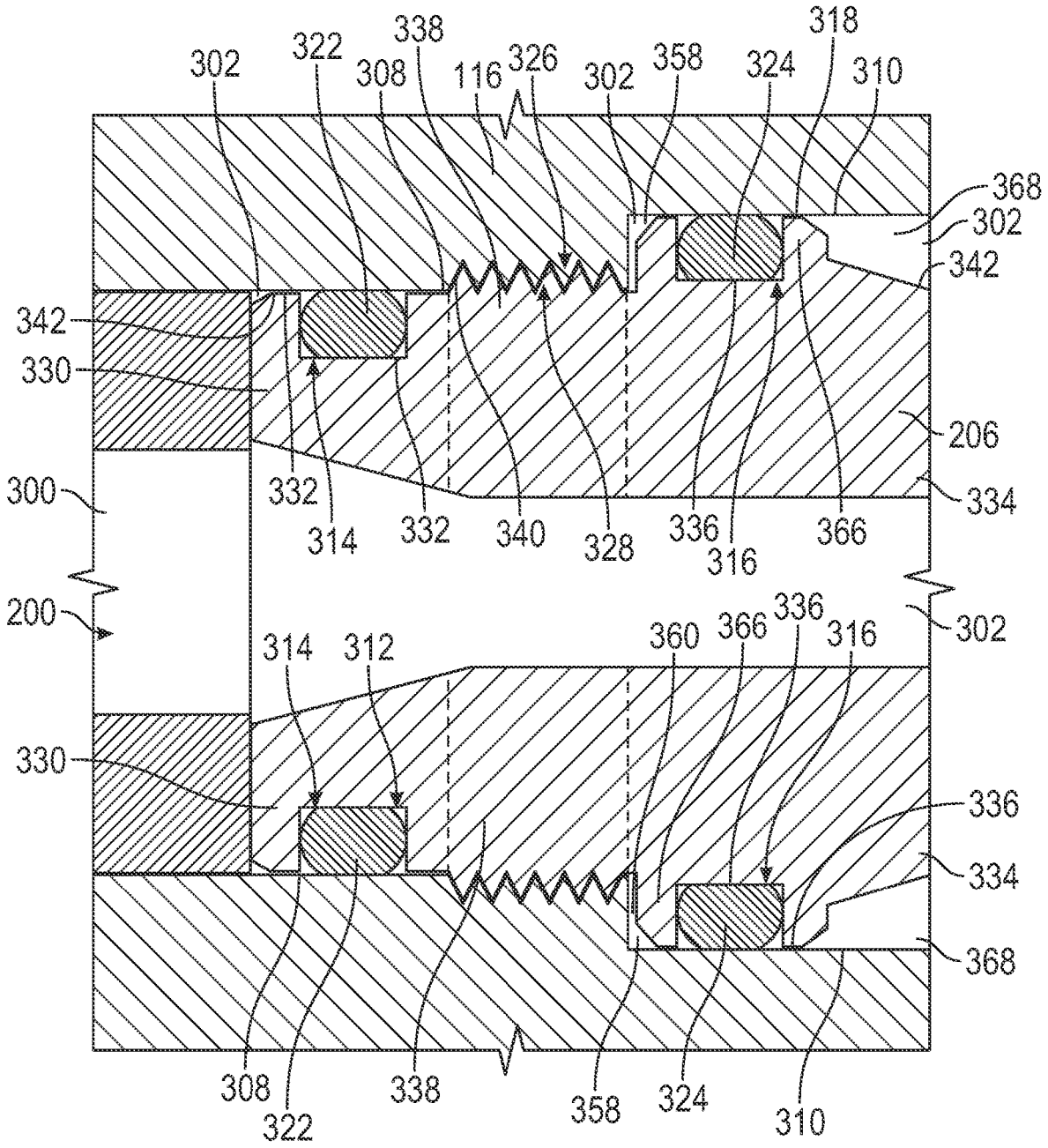
FIG. 6 illustrates a cross-sectional view of nozzle insert having recesses for housing sealing features, in accordance with some embodiments of the present disclosure.

FIG. 6 illustrates a cross-sectional view of nozzle insert having recesses for housing sealing features, in accordance with some embodiments of the present disclosure. As set forth above, the downhole drill bit 116 includes the at least one nozzle bore 200 with the main bore portion 300 and the nozzle portion 302. The nozzle portion 302 may have a stepped diameter with the diameter of the second inner surface 310 being greater than the diameter of the first inner surface 308. As illustrated, the plurality of recesses 312 (e.g., the first recess 314 and the second recess 316) may not be formed in the inner surface 318 of the nozzle portion 302. Instead, the plurality of recesses 312 may be formed in the radially outer surface 342 of the nozzle insert 206.

The nozzle insert 206 may be secured at least partially within the nozzle portion 302 of the at least one nozzle bore 200. Moreover, as set forth above, the nozzle insert 206 may include the first annular body portion 330 having the first radially outer sealing surface 332 configured to seal against the first inner surface 308 of the nozzle bore 200 via the first seal feature 322. As illustrated, the first recess 314 may be formed in the first radially outer sealing surface 332 of the first annular body portion 330. Further, the first recess 314 may be configured to house the first seal feature 322. As such, the first seal feature 322 may be disposed between the first recess 314 formed in the first radially outer sealing surface 332 and the first inner surface 308 of the nozzle bore 200 to seal the first radially outer sealing surface 332 against the first inner surface 308.

The nozzle insert 206 may also include the second annular body portion 334 having the second radially outer sealing surface 336 configured to seal against the second inner surface 310 of the nozzle bore 200 via the second seal feature 324. As illustrated, the second recess 316 may be formed in the second radially outer sealing surface 336 of the second annular body portion 334. Further, the second recess 316 may be configured to house the second seal feature 324. As such, the second seal feature 324 may be disposed between the second recess 316 formed in the second radially outer sealing surface 336 and the second inner surface 310 of the nozzle bore 200 to seal the second radially outer sealing surface 336 against the second inner surface 310.

Further, the nozzle insert 206 may include the annular threaded body portion 338 having insert threading 328 configured to interface with the corresponding bore threading 326 of the at least one nozzle bore 200 to secure the nozzle insert 206 within the at least one nozzle bore 200. The insert threading 328 may be formed in the radially outer surface 340 of the annular threaded body portion 338. The insert threading 328 may be radially aligned with the first radially outer sealing surface 332. However, the insert threading 328 may be disposed in any suitable radial position with respect to the first radially outer sealing surface 332 and the second radially outer sealing surface 336. Moreover, as illustrated, the annular threaded body portion 338 may be disposed axially between the first annular body portion 330 and the second annular body portion 334.

Moreover, the nozzle pressure chamber 358 may be formed in the annular gap 360 positioned between the first seal feature 322, the second seal feature 324, the radially outer surface 342 of the nozzle insert 206, and the radially inner surface 318 of the at least one nozzle bore 200. As set forth above, the second inner surface 310 may be disposed radially outward from the first inner surface 308 such that the second seal feature 324 seals against the second inner surface 310 at a position radially outward from where the first seal feature 322 seals against the first inner surface 308 of the nozzle portion 302. As illustrated, the nozzle pressure chamber 358 may extend radially outward from the first inner surface 308 to the second inner surface 310. Moreover, the first annular body portion 330 may be disposed radially inward from the nozzle pressure chamber 358. However, at least the radial protrusion portion 366 of the second annular body portion 334 may be disposed axially between the nozzle pressure chamber 358 and the open portion 368 of the nozzle bore 200. As set forth above, the nozzle pressure chamber 358 may contain fluid at atmospheric pressure, which may be lower than the wellbore pressure in the open portion 368 of the nozzle bore 200. The pressure differential between the nozzle pressure chamber 358 and the open portion 368 may generate the retaining force to bias the nozzle insert 206 into the nozzle bore 200 and help retain the nozzle insert 206 within the nozzle bore 200 during drilling operations.

Figure 7:
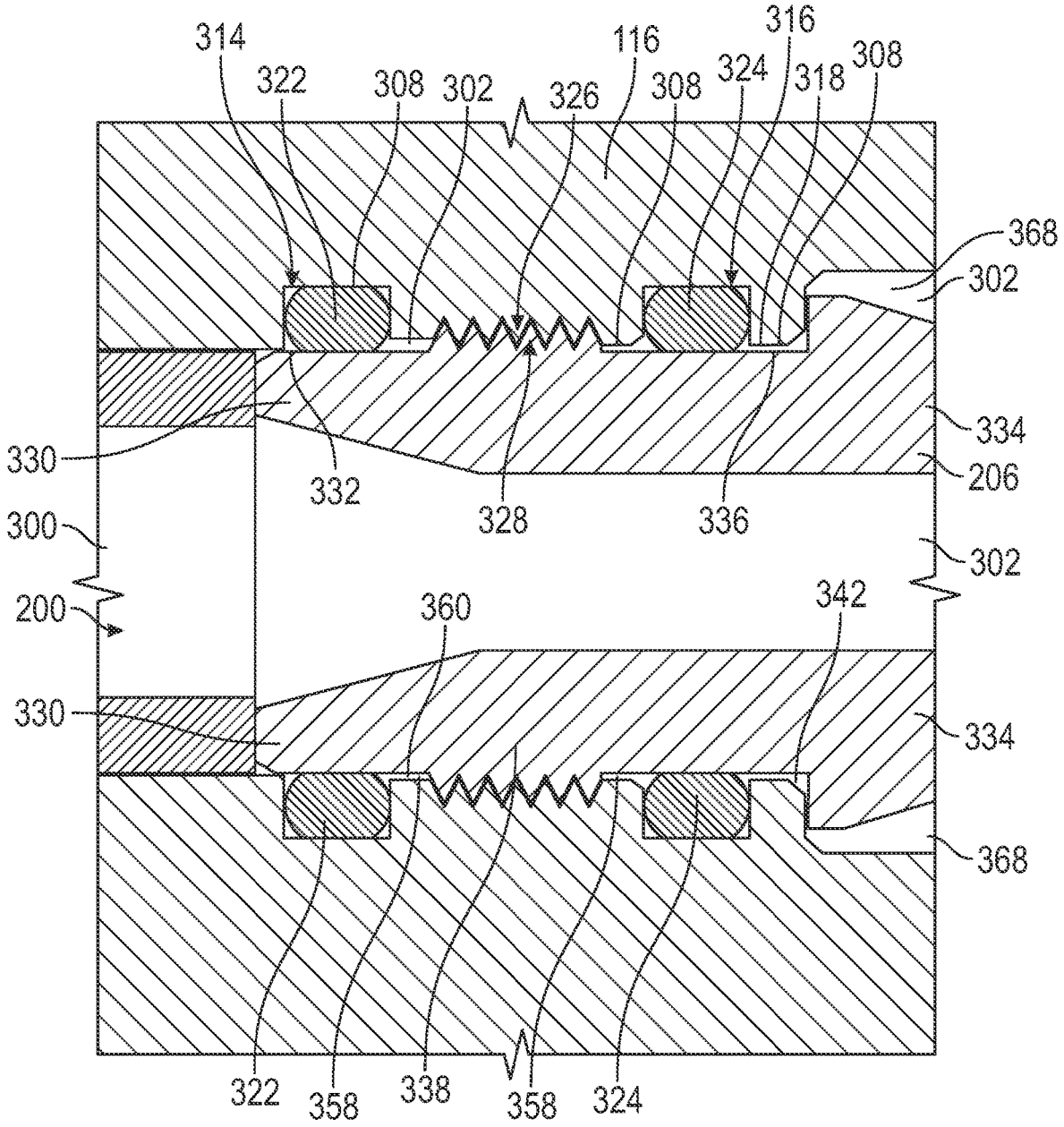
FIG. 7 illustrates a cross-sectional view of nozzle insert with radially aligned sealing features, in accordance with some embodiments of the present disclosure.

FIG. 7 illustrates a cross-sectional view of nozzle insert with radially aligned sealing features, in accordance with some embodiments of the present disclosure. As set forth above, the downhole drill bit 116 includes the at least one nozzle bore 200 with the main bore portion 300 and the nozzle portion 302. As illustrated, the nozzle portion 302 may have a uniform diameter. That is, the first recess 314 and the second recess 316 may both be formed in the first inner surface 308 of the nozzle portion 302. Further, the bore threading 326 may be formed on the first inner surface 308 of nozzle portion 302 between the first recess 314 and the second recess 316. However, the bore threading 326 may be formed in any suitable portion of the inner surface 318 of the nozzle portion 302. Further, as set forth above, the bore threading 326 may be configured to interface with the corresponding insert threading 328 of the nozzle insert 206.

Moreover, the nozzle insert 206 may be secured at least partially within the nozzle portion 302 of the at least one nozzle bore 200. As set forth above, the nozzle insert 206 may include the first annular body portion 330 having the first radially outer sealing surface 332 configured to seal against the first inner surface 308 of the nozzle bore 200 via the first seal feature 322. The nozzle insert 206 may also include the second annular body portion 334 having the second radially outer sealing surface 336 configured to seal against the first inner surface 308 of the nozzle bore 200 via the second seal feature 324. Moreover, the second radially outer sealing surface 336 of the second annular body portion 334 may be radially aligned with the first radially outer sealing surface 332 of the first annular body portion 330. That is, the outer diameter of the second annular body portion 334 may substantially the same as the outer diameter of the first annular body portion 330 such that the second radially outer sealing surface 336 may be radially aligned with the first radially outer sealing surface 332.

Further, the nozzle insert 206 may include the annular threaded body portion 338 having the insert threading 328 configured to interface with the corresponding bore threading 326 of the at least one nozzle bore 200 to secure the nozzle insert 206 within the at least one nozzle bore 200. The annular threaded body portion 338 may be disposed axially between the first annular body portion 330 and the second annular body portion 334. At least a portion of the insert threading 328 may be radially aligned with the first radially outer sealing surface 332 and the second radially outer sealing surface 336. However, the insert threading 328 may be disposed in any suitable radial position with respect to the first radially outer sealing surface 332 and the second radially outer sealing surface 336.

As illustrated, the nozzle pressure chamber 358 may be formed in the annular gap 360 positioned between the first seal feature 322, the second seal feature 324, the radially outer surface 342 of the nozzle insert 206 and the radially inner surface 318 of the at least one nozzle bore 200. However, as the first radially outer sealing surface 332 is radially aligned with the second radially outer sealing surface 336 and the first recess 314 is radially aligned with the second recess 316, the first seal feature 322 and the second seal feature 324 may extend out of the first recess 314 and the second recess 316, respectively, to form the annular gap 360 between the radially outer surface 342 of the nozzle insert 206 and the radially inner surface 318 of the at least one nozzle bore 200. As illustrated, the nozzle pressure chamber 358 may include the annular gap 360 formed between the first seal feature 322 and the second seal feature 324. As set forth above, the nozzle pressure chamber 358 may contain fluid at atmospheric pressure, which may be lower than the wellbore pressure in the open portion 368 of the nozzle bore 200. Although the nozzle pressure chamber 358 may not generate an axial force, since the first seal feature 322 is radially aligned with the second seal feature 324, the pressure differential between the nozzle pressure chamber 358 and the open portion 368 may still generate at least a portion of the retaining force (e.g., a radial force) to help retain the nozzle insert 206 within the nozzle bore 200 during drilling operations.

Accordingly, the present disclosure may provide systems and methods for retaining a nozzle insert within a nozzle bore of a downhole tool. The systems and methods may include any of the various features disclosed herein, including one or more of the following statements.

Statement 1. A downhole nozzle insert, comprising: a first annular body portion having a first radially outer sealing surface configured to be sealed against a first inner surface of a nozzle bore of a downhole drill bit via a first seal feature; a second annular body portion having a second radially outer sealing surface configured to be sealed against a second inner surface of the nozzle bore via a second seal feature, wherein a pressure chamber is formed between the first seal feature and the second seal feature to provide a retaining force on the first annular body portion and/or the second annular body portion; and an annular threaded body portion having threading configured to interface with corresponding threading of the nozzle bore to secure at least the annular threaded body portion within the nozzle bore.

Statement 2. The downhole nozzle insert of statement 1, wherein the pressure chamber comprises a substantially atmospheric pressure, wherein a pressure differential between the pressure chamber and a wellbore pressure generates the retaining force.

Statement 3. The downhole nozzle insert of statement 1 or statement 2, further comprising an orifice extending axially through the first annular body portion, the second annular body portion and the annular threaded body portion, wherein the orifice is configured to receive fluid flow from the nozzle bore and direct the fluid flow toward a wellbore.

Statement 4. The downhole nozzle insert of claim 1, wherein the second radially outer sealing surface is disposed radially outward from the first radially outer sealing surface, and wherein the second radially outer sealing surface is disposed axially between a wellbore and the first radially outer sealing surface.

Statement 5. The downhole nozzle insert of claim 1, wherein the annular threaded body portion is disposed between the first annular body portion and the second annular body portion.

Statement 6. The downhole nozzle insert of claim 1, wherein the second radially outer sealing surface of the second annular body portion is disposed radially outward from threading of the annular threaded body portion.

Statement 7. The downhole nozzle insert of any of statements 1-4 or 6, wherein the annular threaded body portion is disposed between the second annular body portion and a wellbore, and wherein the first annular body portion is disposed between a main bore portion of the nozzle bore and the second annular body portion.

Statement 8. The downhole nozzle insert of any of statements 1-4 or 6, wherein the annular threaded body portion is disposed between a main bore portion of the nozzle bore and the first annular body portion, and wherein the first annular body portion is disposed between the annular threaded portion and the second annular body portion.

Statement 9. The downhole nozzle insert of any preceding statement, wherein the first annular body portion includes a first recess formed in the first radially outer sealing surface, wherein the first recess is configured to at least partially house the first seal feature, and wherein the second annular body portion includes a second recess formed in the second radially outer sealing surface, wherein the second recess is configured to at least partially house the second seal feature.

Statement 10. The downhole nozzle insert of any preceding statement, further comprising the first seal feature and the second seal feature, wherein the first seal feature comprises a first O-ring disposed about the first annular body portion, wherein the second seal feature comprises a second O-ring disposed about the second annular body portion.

Statement 11. The downhole nozzle insert of any preceding statement, wherein the first annular body portion comprises an inner axial face, wherein the inner axial face is configured to interface with a nozzle sleeve disposed within a main bore portion of the nozzle bore to restrain axially inward movement of the nozzle insert with respect to the nozzle bore.

Statement 12. A downhole system, comprising: a downhole drill bit having at least one nozzle bore; a nozzle insert secured at least partially within the at least one nozzle bore, wherein the nozzle insert is configured to direct drilling fluid into a wellbore, and wherein the nozzle insert comprises: a first annular body portion having a first radially outer sealing surface sealed against a first inner surface of the nozzle bore; a second annular body portion having a second radially outer sealing surface sealed against a second inner surface of the nozzle bore; and an annular threaded body portion having insert threading configured to interface with corresponding bore threading of the at least one nozzle bore to secure the nozzle insert within the at least one nozzle bore; a first seal feature disposed between the first radially outer sealing surface and the first inner surface of the nozzle bore to seal the first radially outer sealing surface against the first inner surface; a second seal feature disposed between the second radially outer sealing surface and the second inner surface of the nozzle bore to seal the second radially outer sealing surface against the second inner surface; and a nozzle pressure chamber formed between the first seal feature, the second seal feature, a radially outer surface of the nozzle insert, and a radially inner surface of the at least one nozzle bore, wherein the nozzle pressure chamber is configured to provide a retaining force on the nozzle insert.

Statement 13. The downhole system of statement 12, wherein the second radially outer sealing surface is disposed radially outward from the first radially outer sealing surface, and wherein the second radially outer sealing surface is disposed axially between the wellbore and the first radially outer sealing surface.

Statement 14. The downhole system of statement 12 or statement 13, further comprising a third seal feature and a fourth seal feature, wherein the third seal feature is disposed adjacent to the first seal feature, and wherein the fourth seal feature is disposed adjacent to the second seal feature.

Statement 15. The downhole system of any of statements 12-14, wherein the at least one nozzle bore comprises a first recess formed in the first inner surface of the nozzle bore and a second recess formed in the second inner surface of the nozzle bore, wherein the first recess is configured to house the first seal feature, and wherein the second recess is configured to house the second seal feature.

Statement 16. The downhole system of any of statements 12-15, wherein at least one nozzle bore includes a variable diameter, and wherein a diameter of the second inner surface is greater than the diameter of the first inner surface.

Statement 17. The downhole system of any of statements 12-16, wherein the at least one nozzle bore comprises a nozzle bore shoulder formed at a transition between a main bore portion of the nozzle bore and the first inner surface of the at least one nozzle bore.

Statement 18. The downhole system of any of statements 12-17, wherein the first seal feature comprises a first O-ring disposed about the first annular body portion, and wherein the second seal feature comprises a second O-ring disposed about the second annular body portion.

Statement 19. The downhole system of any of statements 12-18, wherein the downhole drill bit further comprises a fixed cutter drill bit having at least one blade and at least one cutting element secured to the at least one blade.

Statement 20. A method, comprising: threading a downhole insert into a nozzle bore of a downhole drill bit at surface to seal a nozzle pressure chamber at atmospheric pressure, wherein the downhole insert comprises: a first annular body portion having a first radially outer sealing surface configured to be sealed against a first inner surface of a nozzle bore of a downhole drill bit via a first seal feature; a second annular body portion having a second radially outer sealing surface configured to be sealed against a second inner surface of the nozzle bore via a second seal feature, wherein the nozzle pressure chamber is formed between the first seal feature and the second seal feature to provide a retaining force on the first annular body portion and/or the second annular body portion; and an annular threaded body portion having threading configured to interface with corresponding threading of the nozzle bore to hold at least the annular threaded body portion within the nozzle bore.

The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole nozzle insert, comprising:

a first annular body portion having a first radially outer sealing surface configured to be sealed against a first inner surface of a nozzle bore of a downhole drill bit via a first seal feature;

a second annular body portion having a second radially outer sealing surface configured to be sealed against a second inner surface of the nozzle bore via a second seal feature, wherein a pressure chamber is formed between the first seal feature and the second seal feature to provide a retaining force on the first annular body portion and/or the second annular body portion; and an annular threaded body portion having threading configured to interface with corresponding threading of the nozzle bore to secure at least the annular threaded body portion within the nozzle bore.

2. The downhole nozzle insert of claim 1, wherein the pressure chamber comprises a substantially atmospheric pressure, wherein a pressure differential between the pressure chamber and a wellbore pressure generates the retaining force.

3. The downhole nozzle insert of claim 1, further comprising an orifice extending axially through the first annular body portion, the second annular body portion and the annular threaded body portion, wherein the orifice is configured to receive fluid flow from the nozzle bore and direct the fluid flow toward a wellbore.

4. The downhole nozzle insert of claim 1, wherein the second radially outer sealing surface is disposed radially outward from the first radially outer sealing surface, and wherein the second radially outer sealing surface is disposed axially between a wellbore and the first radially outer sealing surface.

5. The downhole nozzle insert of claim 1, wherein the annular threaded body portion is disposed between the first annular body portion and the second annular body portion.

6. The downhole nozzle insert of claim 1, wherein the second radially outer sealing surface of the second annular body portion is disposed radially outward from threading of the annular threaded body portion.

7. The downhole nozzle insert of claim 1, wherein the annular threaded body portion is disposed between the second annular body portion and a wellbore, and wherein the first annular body portion is disposed between a main bore portion of the nozzle bore and the second annular body portion.

8. The downhole nozzle insert of claim 1, wherein the annular threaded body portion is disposed between a main bore portion of the nozzle bore and the first annular body portion, and wherein the first annular body portion is disposed between the annular threaded portion and the second annular body portion.

9. The downhole nozzle insert of claim 1, wherein the first annular body portion includes a first recess formed in the first radially outer sealing surface, wherein the first recess is configured to at least partially house the first seal feature, and wherein the second annular body portion includes a second recess formed in the second radially outer sealing surface, wherein the second recess is configured to at least partially house the second seal feature.

10. The downhole nozzle insert of claim 1, further comprising the first seal feature and the second seal feature, wherein the first seal feature comprises a first O-ring disposed about the first annular body portion, wherein the second seal feature comprises a second O-ring disposed about the second annular body portion.

11. The downhole nozzle insert of claim 1, wherein the first annular body portion comprises an inner axial face, wherein the inner axial face is configured to interface with a nozzle sleeve disposed within a main bore portion of the nozzle bore to restrain axially inward movement of the nozzle insert with respect to the nozzle bore.

12. A downhole system, comprising:

a downhole drill bit having at least one nozzle bore;

a nozzle insert secured at least partially within the at least one nozzle bore, wherein the nozzle insert is configured to direct drilling fluid into a wellbore, and wherein the nozzle insert comprises:

a first annular body portion having a first radially outer sealing surface sealed against a first inner surface of the nozzle bore;

a second annular body portion having a second radially outer sealing surface sealed against a second inner surface of the nozzle bore; and an annular threaded body portion having insert threading configured to interface with corresponding bore threading of the at least one nozzle bore to secure the nozzle insert within the at least one nozzle bore;

a first seal feature disposed between the first radially outer sealing surface and the first inner surface of the nozzle bore to seal the first radially outer sealing surface against the first inner surface;

a second seal feature disposed between the second radially outer sealing surface and the second inner surface of the nozzle bore to seal the second radially outer sealing surface against the second inner surface; and a nozzle pressure chamber formed between the first seal feature, the second seal feature, a radially outer surface of the nozzle insert, and a radially inner surface of the at least one nozzle bore, wherein the nozzle pressure chamber is configured to provide a retaining force on the nozzle insert.

13. The downhole system of claim 12, wherein the second radially outer sealing surface is disposed radially outward from the first radially outer sealing surface, and wherein the second radially outer sealing surface is disposed axially between the wellbore and the first radially outer sealing surface.

14. The downhole system of claim 12, further comprising a third seal feature and a fourth seal feature, wherein the third seal feature is disposed adjacent to the first seal feature, and wherein the fourth seal feature is disposed adjacent to the second seal feature.

15. The downhole system of claim 12, wherein the at least one nozzle bore comprises a first recess formed in the first inner surface of the nozzle bore and a second recess formed in the second inner surface of the nozzle bore, wherein the first recess is configured to house the first seal feature, and wherein the second recess is configured to house the second seal feature.

16. The downhole system of claim 12, wherein at least one nozzle bore includes a variable diameter, and wherein a diameter of the second inner surface is greater than the diameter of the first inner surface.

17. The downhole system of claim 12, wherein the at least one nozzle bore comprises a nozzle bore shoulder formed at a transition between a main bore portion of the nozzle bore and the first inner surface of the at least one nozzle bore.

18. The downhole system of claim 12, wherein the first seal feature comprises a first O-ring disposed about the first annular body portion, and wherein the second seal feature comprises a second O-ring disposed about the second annular body portion.

19. The downhole system of claim 12, wherein the downhole drill bit further comprises a fixed cutter drill bit having at least one blade and at least one cutting element secured to the at least one blade.

20. A method, comprising:

threading a downhole insert into a nozzle bore of a downhole drill bit at surface to seal a nozzle pressure chamber at atmospheric pressure, wherein the downhole insert comprises:

a first annular body portion having a first radially outer sealing surface configured to be sealed against a first inner surface of a nozzle bore of a downhole drill bit via a first seal feature;

a second annular body portion having a second radially outer sealing surface configured to be sealed against a second inner surface of the nozzle bore via a second seal feature, wherein the nozzle pressure chamber is formed between the first seal feature and the second seal feature to provide a retaining force on the first annular body portion and/or the second annular body portion; and an annular threaded body portion having threading configured to interface with corresponding threading of the nozzle bore to hold at least the annular threaded body portion within the nozzle bore.

* * * * *